US006996871B1

(12) United States Patent
Policicchio

(10) Patent No.: US 6,996,871 B1
(45) Date of Patent: Feb. 14, 2006

(54) CLEANING PAD

(75) Inventor: Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 329 days.

(21) Appl. No.: 09/723,025

(22) Filed: Nov. 27, 2000

Related U.S. Application Data

(63) Continuation-in-part of application No. PCT/US99/26579, filed on Nov. 9, 1999.

(60) Provisional application No. 60/162,935, filed on Nov. 2, 1999, provisional application No. 60/110,476, filed on Dec. 1, 1998, provisional application No. 60/184,780, filed on Feb. 24, 2000.

(51) Int. Cl.
*A47L 13/20* (2006.01)

(52) U.S. Cl. ..... 15/228; 15/209.1

(58) Field of Classification Search ..... 15/208, 15/209.1, 223, 224, 226, 228, 229.1, 229.6, 15/231, 232
See application file for complete search history.

(56) References Cited

U.S. PATENT DOCUMENTS

| | | | | | |
|---|---|---|---|---|---|
| 759,155 | A | * | 5/1904 | Burt et al | 15/224 |
| 865,762 | A | * | 9/1907 | Chapot | 15/226 |
| 2,534,982 | A | * | 12/1950 | Mayes | 15/223 |
| 2,655,680 | A | * | 10/1953 | Geerin | 15/228 |
| 2,779,044 | A | * | 1/1957 | Brockmeier et al | 15/228 |
| 3,015,834 | A | * | 1/1962 | Marrinson et al | 15/228 |
| 3,406,420 | A | * | 10/1968 | Siemund | 15/121 |
| 3,789,451 | A | * | 2/1974 | Laitner | 15/223 X |
| 4,455,705 | A | * | 6/1984 | Graham | 15/121 |
| 4,951,341 | A | * | 8/1990 | Shears | 15/228 |
| 4,961,242 | A | * | 10/1990 | Kresse et al. | 15/228 |
| 5,012,544 | A | * | 5/1991 | Verry | 15/209.1 |
| 5,027,468 | A | * | 7/1991 | Leventhal et al. | 15/229.1 |
| 5,491,864 | A | * | 2/1996 | Tuthill et al. | 15/118 |

FOREIGN PATENT DOCUMENTS

| | | |
|---|---|---|
| DE | 298 02 009 | 7/1998 |
| EP | 0 358 844 | 3/1990 |
| FR | 2 768 042 | 3/1999 |
| JP | 09140651 | 6/1997 |
| WO | 97/35510 | 3/1996 |
| WO | 00/27271 | 5/2000 |

* cited by examiner

*Primary Examiner*—Mark Spisich
(74) *Attorney, Agent, or Firm*—Thibault Fayette; Kim William Zerby; Steven W. Miller

(57) ABSTRACT

An improved cleaning pad is provided. This cleaning pad includes at least one cleaning layer; and
at least one functional cuff attached to the cleaning pad. This cuff can be made of a cuff material and has an inner surface and an outer surface capable of contacting a surface to be cleaned. The functional cuff is designed such that the ratio of the glide force resulting from the contact of the inner surface of the cuff material against itself relative to the glide force resulting from the contact of the outer surface of the cuff material against the material of the surface to be cleaned is smaller than 1.

14 Claims, 8 Drawing Sheets

CLEANING PAD

CROSS-REFERENCE TO RELATED APPLICATIONS

This application is a Continuation-in-part of International Application Serial No. PCT/US99/26579 filed Nov. 9, 1999 by Policicchio et al. which claims the benefit of U.S. Provisional Application Ser. No. 60/162,935 filed Nov. 2, 1999 by Policicchio et al and U.S. Provisional Application Ser. No. 60/110,476 filed Dec. 1, 1998 by Policicchio et al. This application also claims the benefit of U.S. Provisional application Ser. No. 60/184,780 filed Feb. 24, 2000 to Willman et al. All the foregoing patent applications are hereby incorporated by reference: U.S. application Ser. No. 09/188,604, U.S. Pat. No. 6,206,058, filed Nov. 9, 1998 by Nagel et al.; U.S. application Ser. No. 09/201,618, U.S. Pat. No. 6,142,750, filed Nov. 30, 1998 by Benecke; and U.S. Provisional Application Ser. No. 60/156,286 filed Sep. 27, 1999 by Sherry et al.

TECHNICAL FIELD

The present invention relates to cleaning implements and cleaning sheets particularly suitable for removal and entrapment of dust, lint, hair, sand, food crumbs, grass and the like.

BACKGROUND OF THE INVENTION

Many sorts of cleaning sheets are known in the art that can be used in synergy with cleaning implements. Those cleaning sheets have been shown to be rather efficient in allowing the trapping of relatively small particles which compose the dirt or soil covering the surface to be cleaned. However, those cleaning sheets are not as successful to trap larger particles or larger lint, hair and dirt. One of the solutions to this problem was to add functional cuffs to the leading and trailing edges of a cleaning pad to trap larger particles as the mop is wiped back and forth. However, one of the drawback of those functional cuffs is that depending on the kind of surface to be cleaned, the kind of implement they are used with or the amount of pressure applied by the user, some functional cuffs tend to slide on the floor instead of rolling back and forth and therefore do not perform their function of trapping particles optimally. It is therefore another object of this invention to provide an improved pad including improved functional cuffs.

SUMMARY OF THE INVENTION

In one aspect, the present invention relates to a cleaning pad comprising:

at least a cleaning layer; and at least a functional cuff attached to said pad comprising a cuff material and having an inner surface and an outer surface capable of contacting a surface to be cleaned wherein the ratio of the glide force resulting from the contact of the inner surface of said cuff material against itself relative to the glide force resulting from the contact of the outer surface of said cuff material against the material of the surface to be cleaned is smaller than 1.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Definitions

Figure 1:
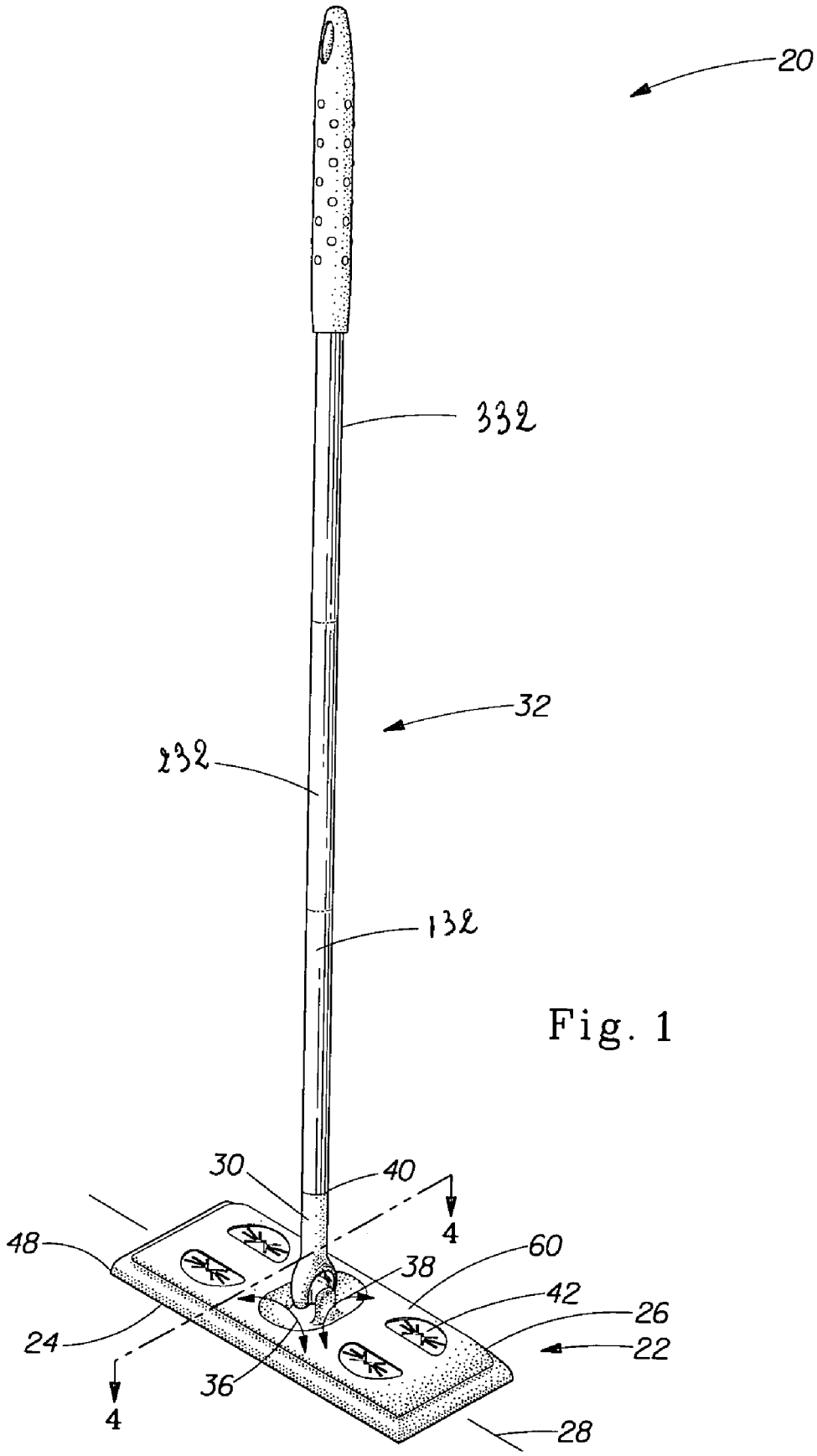
FIG. 1 is a perspective view of a floor mop suitable for use with the present invention.

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "direct fluid communication" means that fluid can transfer readily between two cleaning pad components or layers (e.g., the scrubbing layer and the absorbent layer) without substantial accumulation, transport, or restriction by an interposed layer. For example, tissues, nonwoven webs, construction adhesives, and the like can be present between the two distinct components while maintaining "direct fluid communication", as long as they do not substantially impede or restrict fluid as it passes from one component or layer to another.

As used herein, the term "macroscopically expanded", when used to describe three-dimensional plastic webs, ribbons, and films, refers to webs, ribbons, and films which have been caused to conform to the surface of a three-dimensional forming structure so that both surfaces thereof exhibit the three-dimensional pattern of said forming structure, said pattern being readily visible to the naked eye when the perpendicular distance between the viewer's eye and the plane of the web is about 12 inches. Such macroscopically expanded webs, ribbons and films are typically caused to conform to the surface of said forming structures by embossing, i.e., when the forming structure exhibits a pattern comprised primarily of male projections, by debossing, i.e., when the forming structure exhibits a pattern comprised primarily of female capillary networks, or by extrusion of a resinous melt directly onto the surface of a forming structure of either type. By way of contrast, the term "planar", when utilized herein to describe plastic webs, ribbons and films, refers to the overall condition of the web, ribbon or film when viewed by the naked eye on a macroscopic scale. In this context, "planar" webs, ribbons and films can include webs, ribbons and films having fine scale surface aberrations on one or both sides, said surface aberrations not being readily visible to the naked eye when the perpendicular distance between the viewer's eye and the plane of the web is about 12 inches or greater.

As used herein, the term "z-dimension" refers to the dimension orthogonal to the length and width of the cleaning pad of the present invention, or a component thereof. The z-dimension therefore corresponds to the thickness of the cleaning pad or a pad component.

As used herein, the term "x-y dimension" refers to the plane orthogonal to the thickness of the cleaning pad, or a component thereof. The x and y dimensions correspond to the length and width, respectively, of the cleaning pad or a pad component. In general, when the cleaning pad is used in conjunction with a handle, the implement will be moved in a direction parallel to the y-dimension (or width) of the pad. (See FIG. 1, and the discussion below.) Of course, the present invention is not limited to cleaning pads having four sides. Other shapes, such as circular, elliptical, and the like, can also be used. When determining the width of the pad at any point in the z-dimension, it is understood that the pad is assessed according to its intended use.

As used herein, the term "layer" refers to a member or component of a cleaning pad whose primary dimension is x-y, i.e., along its length and width. It should be understood that the term layer is not necessarily limited to single layers or sheets of material. Thus a layer can comprise laminates or combinations of several sheets or webs of the requisite type of materials. Accordingly, the term "layer" includes the terms "layers" and "layered."

As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled *Contact Angle, Wettability and Adhesion*, edited by Robert F. Gould (Copyright 1964), which is hereby incorporated herein by reference. A surface is said to be wetted by a fluid (i.e., hydrophilic) when either the contact angle between the fluid and the surface is less than 90°, or when the fluid tends to spread spontaneously across the surface, both conditions normally co-existing. Conversely, a surface is considered to be "hydrophobic" if the contact angle is greater than 90° and the fluid does not spread spontaneously across the surface.

As used herein, the term "scrim" means any durable material that provides texture to the surface-contacting side of the cleaning pad's scrubbing layer, and also has a sufficient degree of openness to allow the requisite movement of fluid to the absorbent layer of the cleaning pad. Suitable materials include materials that have a continuous, open structure, such as synthetic and wire mesh screens. The open areas of these materials can be readily controlled by varying the number of interconnected strands that comprise the mesh, by controlling the thickness of those interconnected strands, etc. Other suitable materials include those where texture is provided by a discontinuous pattern printed on a substrate. In this aspect, a durable material (e.g., a synthetic) can be printed on a substrate in a continuous or discontinuous pattern, such as individual dots and/or lines, to provide the requisite texture. Similarly, the continuous or discontinuous pattern can be printed onto a release material that will then act as the scrim. These patterns can be repeating or they can be random. It will be understood that one or more of the approaches described for providing the desired texture can be combined to form the optional scrim material. The z direction height and open area of the scrim and or scrubbing substrate layer help to control and or retard the flow of liquid into the absorbent core material. The z height of the scrim and or scrubbing substrate help provide a means of controlling the volume of liquid in contact with the cleaning surface while at the same time controlling the rate of liquid absorption, fluid communication into the absorption core material.

For purposes of the present invention, an "upper" layer of a cleaning pad is a layer that is relatively further away from the surface that is to be cleaned (i.e., in the implement context, relatively closer to the implement handle during use). The term "lower" layer conversely means a layer of a cleaning pad that is relatively closer to the surface that is to be cleaned (i.e., in the implement context, relatively further away from the implement handle during use). As such, the scrubbing layer is preferably the lower-most layer and the absorbent layer is preferably an upper layer relative to the scrubber layer. The terms "upper" and "lower" are similarly used when referring to layers that are multi-ply (e.g., when the scrubbing layer is a two-ply material). In terms of sequential ordering of layers (e.g., first layer, second layer, and third layer), a first layer is a "lower" layer relative to a second layer. Conversely, a third layer is an "upper" layer relative to a second layer. The terms "above" and "below" are used to describe relative locations of two or more materials in a cleaning pad's thickness. By way of illustration, a material A is "above" material B if material B is positioned closer to the scrubbing layer than material A. Similarly, material B is "below" material A in this illustration.

All of the documents and references referred to herein are incorporated by reference, unless otherwise specified. All parts, ratios, and percentages herein, in the Specification, Examples, and claims, are by weight and all numerical limits are used with the normal degree of accuracy afforded by the art, unless otherwise specified.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

In one aspect, the present invention is used in combination with hard surface cleaning compositions, preferably for use with the cleaning pads and/or cleaning implements described herein, comprising:

(a) optionally, from about 0.001% to about 0.5% by weight of the composition of surfactant, preferably selected from the group consisting of alkylpolysaccharides, alkyl ethoxylates, alkyl sulfonates, and mixtures thereof;

(b) optionally, hydrophilic polymer, preferably less than about 0.5% by weight of the composition;

(c) optionally, organic solvent, preferably from about 0.25% to about 7% by weight of the composition and preferably having a boiling point of from about 120° C. to about 180° C.;

(d) optionally, from about 0.01% to about 1% by weight of the composition of mono- or polycarboxylic acid;

(e) optionally, from about 0.01% to about 1% by weight of the composition of odor control agent, preferably cyclodextrin;

(f) optionally, a source of peroxide, preferably from about 0.05% to about 5% by weight of the composition and preferably selected from the group consisting of benzoyl peroxide, hydrogen peroxide, and mixtures thereof;

(g) optionally, from about 0.001% to about 0.1% by weight of the composition of thickening polymer;

(h) aqueous solvent system, preferably at least about 80% by weight of the composition;

(i) optionally, suds suppressor;

(j) optionally, from about 0.005% to about 0.2% by weight of the composition of a perfume comprising:

(i) optionally, from about 0.05% to about 90% by weight of the perfume of volatile, hydrophilic perfume material;

(ii) optionally, at least about 0.2% by weight of the perfume of volatile, hydrophobic perfume material;

(iii) optionally, less than about 10% by weight of the perfume of residual, hydrophilic perfume material;

(iv) less than about 10% by weight of the perfume of residual, hydrophobic perfume material;

(k) optionally, a detergent adjuvant, preferably selected from the group consisting of detergency builder, buffer, preservative, antibacterial agent, colorant, bleaching agents, chelants, enzymes, hydrotropes, corrosion inhibitors, and mixtures thereof.

In one embodiment, the present invention is a cleaning pad, preferably disposable, for cleaning a hard surface, the cleaning pad comprising:

(a) at least one absorbent layer;

(b) optionally, a liquid pervious scrubbing layer; wherein the liquid pervious scrubbing layer is preferably an apertured formed film, more preferably a macroscopically expanded three-dimensional plastic web, having tapered or funnel-shaped apertures and/or surface aberrations and preferably comprising a hydrophobic material;

(c) optionally, an attachment layer, wherein the attachment layer preferably comprises a clear or translucent material, more preferably a clear or translucent polyethylene film, and wherein the attachment layer preferably comprises loop and/or hook material for attachment to a support head of a handle of a cleaning implement;

(d) optionally, multiple planar surfaces;

(e) at least one functional cuff, preferably at least one free-floating, looped functional cuff;

(f) optionally, a density gradient throughout at least one absorbent layer; wherein the density gradient preferably comprises a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/Cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer;

(g) optionally, at least one adhesive scrubbing strip, preferably comprising a material selected from the group consisting of nylon, polyester, polypropylene, abrasive material, and mixtures thereof; and (h) optionally, perfume carrier complex, preferably selected from the group consisting of cyclodextrin inclusion complex, matrix perfume microcapsules, and mixtures thereof; wherein the perfume carrier complex is preferably located in an absorbent layer.

In one aspect of the invention, the cleaning pad comprises at least two absorbent layers, wherein the absorbent layers have multiple widths in the z-dimension and comprises functional cuffs, preferably free-floating, double-layer loop functional cuffs. Preferably, the cleaning pad has a $t_{1200}$ absorbent capacity of at least about 5 grams/gram.

In another aspect, the present invention relates to a cleaning sheet, preferably disposable, for cleaning hard surfaces, the cleaning sheet comprising functional cuffs, preferably free-floating, double-layer loop functional cuffs.

During the effort to develop the present cleaning pads and sheets, Applicants discovered that an important aspect of cleaning performance is related to the ability to provide a cleaning pad having apertured formed films, a liquid impervious attachment layer, and/or density gradients, and/or functional cuffs and a cleaning sheet having functional cuffs. In the context of a typical cleaning operation (i.e., where the cleaning pad and/or sheet is moved back and forth in a direction substantially parallel to the pad's or sheet's y-dimension or width), each of these structural elements provide the cleaning pads and/or sheets improved cleaning performance, both separately and in combination with one or more additional elements. Apertured formed films, preferably utilized in the scrubbing layer, are pervious to liquids and provide efficient transfer of liquid from the surface being cleaned to other layers of the cleaning pad, preferably one or more absorbent layers, while reducing the tendency for such liquid to be squeezed back onto the surface being cleaned. Functional cuffs are preferably free-floating so as to "flip" back and forth in the y-dimension during a typical cleaning operation, thus trapping particulate matter and reducing the tendency for such particulate matter to be redeposited on the surface being cleaned. Density gradients are preferably incorporated in the absorbent layer(s) of the cleaning pad to "pump" or "wick" liquid away from the surface being cleaned to areas in the cleaning pad furthest away from the surface being cleaned. The liquid impervious attachment layer provides a barrier which helps to better distribute the liquid in the x-y direction after liquid reaches the back of the pad which is further set away from cleaning surface. These aspects of the present invention, and the benefits provided, are discussed in detail with reference to the drawings.

The skilled artisan will recognize that various materials can be utilized to carry out the claimed invention. Thus, while preferred materials are described below for the various cleaning implement, pad, and sheet components, it is recognized that the scope of the invention is not limited to such descriptions.

It has been found that incorporating a density gradient throughout the absorbent layer(s) of the cleaning pad used in combination with the present invention has an important effect on cleaning performance and ability of the cleaning pad to quickly absorb liquids, especially liquid containing particulate matter. Although density gradients have been used in absorbent articles such as diapers, sanitary napkins, incontinence devices, and the like, Applicants have discovered specific density gradients uniquely useful for the absorbent layer in cleaning pads. Density gradients in cleaning pads are unique for at least two identifiable reasons. First, the absorbent layer in a cleaning pad needs to handle liquid with both dissolved components and undissolved, suspended components, such as insoluble particulate matter. In the case of diapers, sanitary napkins, incontinence devices, and the like, the absorbent layer typically needs to handle only liquids with dissolved components, such as bodily fluids. Second, the absorbent layer of a cleaning pad needs to absorb liquid against the force of gravity. In terms of diapers, sanitary napkins, incontinence devices, and the like, the absorbent layer typically has the force of gravity to pull liquid into, and distribute it throughout, the absorbent layer. Having sufficient resiliency in the cleaning pad is important, as described below, in maintaining good cleaning performance, especially in cleaning pads comprising a density gradient. The preferred cleaning pads comprising the specific density gradients described herein exhibit improvements in at least three important characteristics affecting hard surface cleaning performance: acquisition (the time required to transfer liquid from the surface being cleaned to the absorbent layer(s) of the cleaning pad), distribution (the liquid wicking ability of the absorbent layer(s) so as to utilize as much of the pad as possible), and rewet (the amount of dirty liquid retained within the absorbent layer(s) and not squeezed out during a cleaning process).

The absorbent layer can comprise a single absorbent layer with a continuous density gradient in the cleaning pad's z-dimension, or multiple absorbent layers having different densities resulting in a density gradient. A continuous density gradient is one in which the material comprising the cleaning pad is homogeneous, but has differing densities throughout the material. A process for creating a continuous density gradient is disclosed in U.S. Pat. No. 4,818,315, issued Apr. 4, 1989 to Hellgren et al., which is hereby incorporated by reference. Preferably, the cleaning pad used in combination with the present invention comprises a density gradient resulting from multiple absorbent layers, preferably three, each having a different density. A density gradient is typically "strong" when the density of the absorbent layers increase from a lower absorbent layer to an upper absorbent layer. Preferably, the present cleaning pads comprise a "strong" density gradient, which provides fast acquisition, better core utilization by effectively wicking liquid in the z- and x-y directions, and a reduced tendency for allowing absorbed liquids, especially those containing undissolved particulate, to be squeezed out. A strong density gradient preferably comprises at least two absorbent layers, with a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer.

In another embodiment, the present cleaning pad comprises a density gradient resulting from three absorbent layers, wherein a first absorbent layer has a density of from about 0.01 g/cm$^3$ to about 0.08 g/cm$^3$, preferably from about 0.03 g/cm$^3$ to about 0.06 g/cm$^3$, and a second absorbent layer has a density of from about 0.03 g/cm$^3$ to about 0.12 g/cm$^3$, preferably from about 0.07 g/cm$^3$ to about 0.1 g/cm$^3$, and a third absorbent layer has a density of from about 0.05 g/cm$^3$ to about 0.2 g/cm$^3$, preferably from about 0.08 g/cm$^3$ to about 0.15 g/cm$^3$; wherein the difference in density between the first absorbent layer and the second absorbent layer, and between the second absorbent layer and the third absorbent layer, is at least about 0.02 g/cm$^3$, preferably at least about 0.04 g/cm$^3$.

In yet another embodiment, a cleaning pad comprises a first absorbent layer having a density of about 0.05 g/cm$^3$, a second absorbent layer having a density of about 0.1 g/cm$^3$, and a third absorbent layer having a density of about 0.15 g/cm$^3$. It is recognized that a such a density gradient can be present in a cleaning pad with or without layers having multiple widths in the z-dimension.

As a result of the density gradient, the porosity, meaning the ratio of the volume of interstices of a material to the volume of its mass, of the absorbent layer will typically decrease as the density increases. The porosity is important, particularly in the context of a cleaning pad for cleaning hard surfaces, because the liquid to be absorbed by the cleaning pad typically contains moderate amounts of relatively large particulate matter. As the soiled liquid enters the cleaning pad through the scrubbing layer, the larger particulate matter becomes entrapped in the interstices of the lower absorbent layers. As the porosity of the absorbent layers decreases, and the density increases, the larger particulate matter becomes trapped in the larger interstices of the lower absorbent layers and the remaining liquid is then transferred to the upper absorbent layers. This allows the liquid to be more easily transferred towards the higher-density layers and allows the particulate matter to remain trapped in the interstices of the lower absorbent layers. As a result, the cleaning pad retains both liquid and particulate matter much more effectively than cleaning pads without a strong density gradient.

Where an absorbent layer has a density of less than about 0.1 g/cm$^3$, the layer tends to be less resilient, which is another important property of the present cleaning pad as discussed below. In order to increase the resiliency of an absorbent layer having a relatively low density, a thermoplastic material, preferably a bicomponent fiber, is combined with the fibers of the absorbent layer. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning pad. While bicomponent fibers are known in the art, they are typically used at levels of less than about 15%. Applicants have found that in order to provide desired resiliency, an absorbent layer having a density of less than about 0.05 g/cm$^3$ preferably comprises at least about 20%, preferably at least about 30%, more preferably at least about 40%, of a thermoplastic material such as a bicomponent fiber. A preferable bicomponent fiber comprises a copolyolefin bicomponent fiber comprising a less than about 81% polyethylene terphthalate core and a less than about 51% copolyolefin sheath and is commercially available from the Hoechst Celanese Corporation under the tradename CELBOND® T-255.

As discussed more fully hereafter, one aspect of the present invention is directed to a mop for use with a removable cleaning sheet or cleaning pad which is attached to a mop head having a resilient bottom surface, a portion of which preferably has a substantially stepped profile which engages the disposable cleaning pad. While the present invention is discussed herein with respect to a floor mop for purposes of simplicity and clarity, it will be understood that the present invention can be used with other types of mops and cleaning implements which have a cleaning sheet or pad releasably secured there about.

Figure 2:
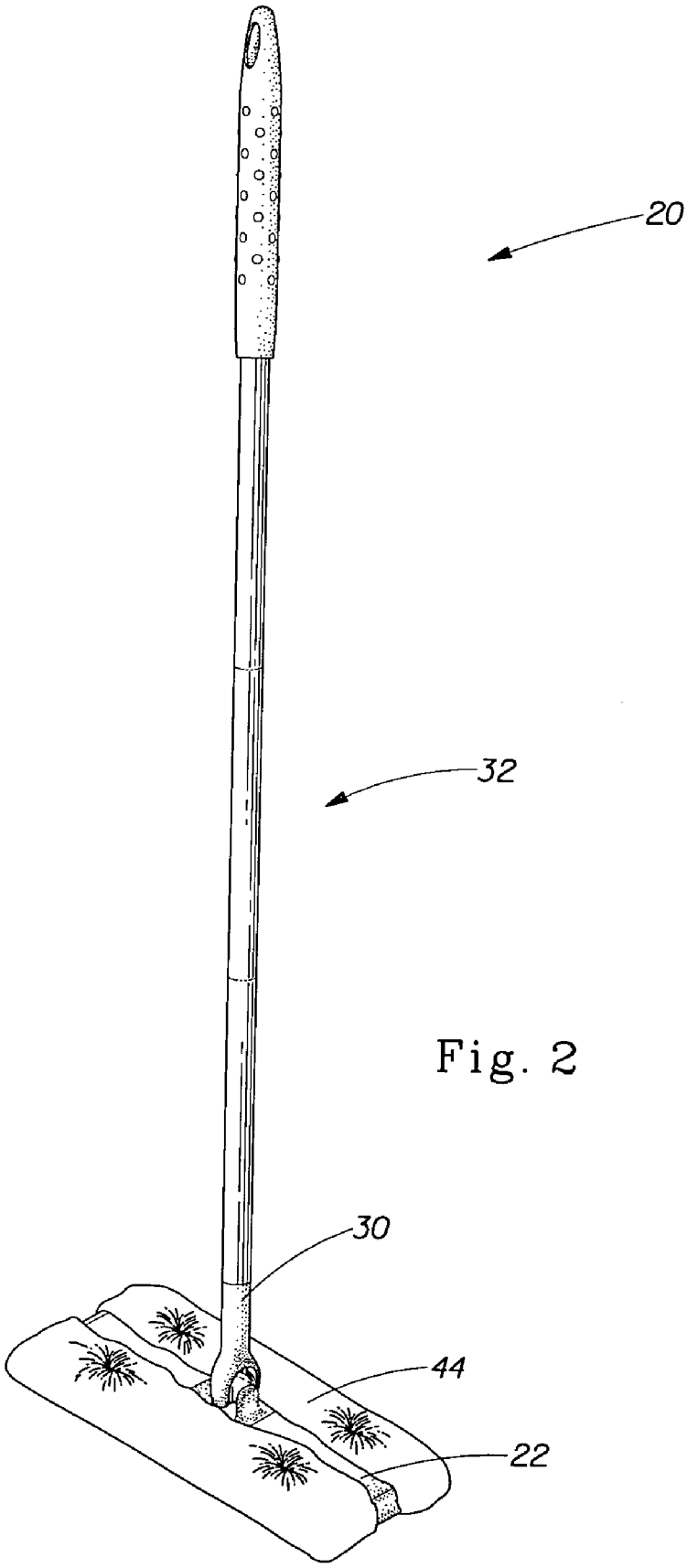
FIG. 2 is a perspective view of a floor mop suitable for use with the present invention, wherein a cleaning sheet is shown disposed about the mop head.
Figure 3:
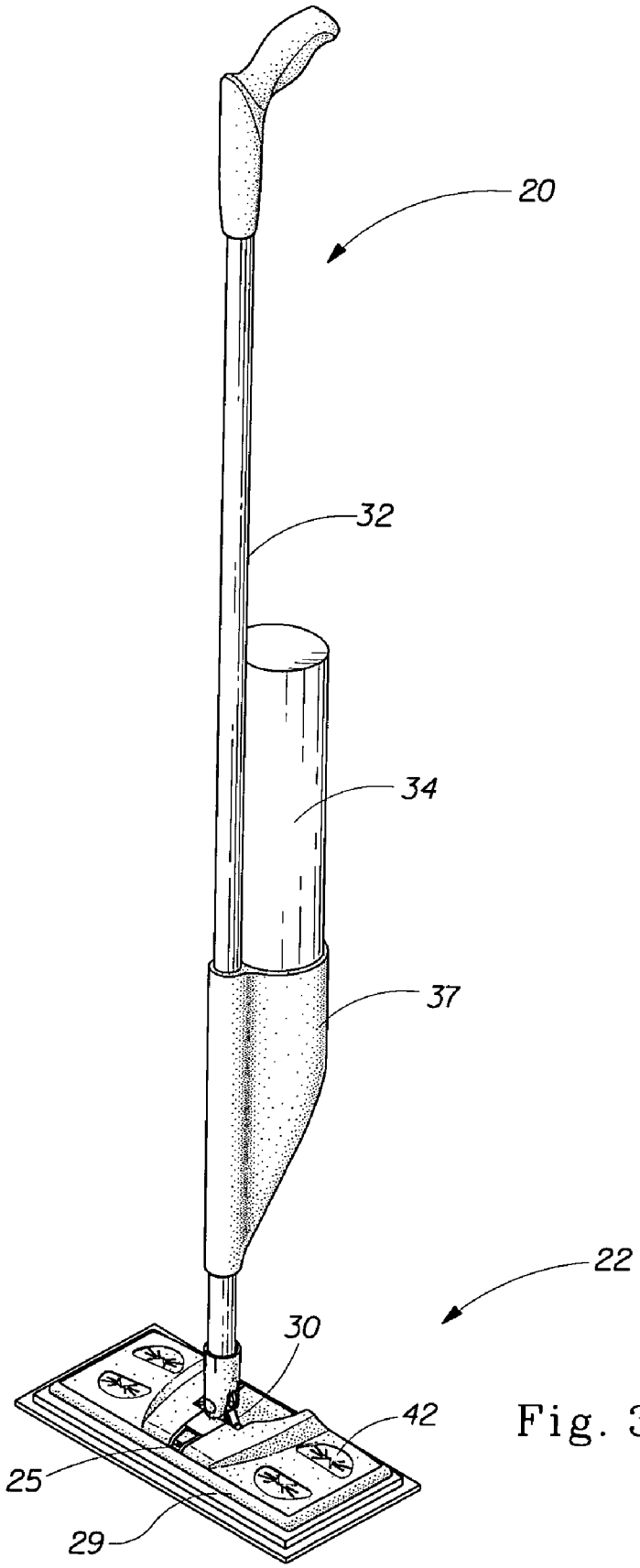
FIG. 3 is perspective view of another floor mop suitable for use with the present invention.

Referring to FIGS. 1 and 2, a floor mop 20 made in accordance with the present invention is illustrated. The floor mop 20 comprises a mop head 22 having a leading edge 24 and a trailing edge 26. As used herein, the term "leading edge" is intended to refer to the furthest edge of the mop head 22 which leads the mop head 22 when it is moved in a forward direction away from its user. Likewise, the term "trailing edge" is intended to refer to the furthest edge of the mop head 22 which trails the mop head 22 when it is moved in a forward direction away from its user. For most floor mops, the leading edge 24 and the trailing edge 26 are substantially parallel to the longitudinal axis 28 of the mop head 22, as shown in FIG. 1, wherein the longitudinal axis 28 is the axis along the length of the mop head 22. A pivotable joint, such as the universal joint 30, interconnects the handle 32 of the mop 20 with the mop head 22. The universal joint 30 comprises two rotational axes which allow the handle 32 to pivot in directions 36 and 38. The handle 32 is threadably interconnected with the universal joint 30 at the connection 40. The handle 32 can be provided as a unitary structure or can comprise three sections 132, 232 and 332 which are threadedly interconnected with each other so that the floor mop 20 can be shipped within a carton of convenient size and later assembled for use. The handle section 38 can be provided with an elastic and resilient portion suitable for gripping by a user of the floor mop 20. The mop head 22 also comprises a plurality of attachment structures 42. The attachment structures 42 are configured to receive and retain a cleaning sheet or pad 44 about the mop head 22, as shown in FIG. 2, during use. The attachment structures 42 are preferably disposed at the corners of the mop head 22, although these locations can be varied depending upon the size and shape of the mop head 22. The attachment structures 42 are preferably provided in the form described in copending US application Ser. No. 09/374,714, filed Aug. 13, 1999, U.S. Pat. No. 6,305,046, naming Kingry et al. as joint inventors, the substance of which is hereby fully incorporated herein by reference. The floor mop 20 is preferably used in combination with the disposable cleaning sheet 44 which is releasably attached to the mop head 22 using the slitted attachment structures 42. In another embodiment of the invention, the mop 20 comprises a handle 32, a support head or mop head 22 attached to the handle by a universal joint 30, and a container 34 in fluid communication with a liquid delivery system which includes at least a spray nozzle 25 preferably attached to the mop head 22, one such arrangement being described in U.S. Pat. No. 5,888,006 to Ping et al., issued Mar. 30, 1999, the substance of which is hereby fully incorporated herein by reference.

The cleaning sheet or pad can be provided in the form of a woven or non-woven fabric capable of uniformly absorbing a liquid or having gradient of density of absorption, as discussed more fully hereafter.

Figure 4:
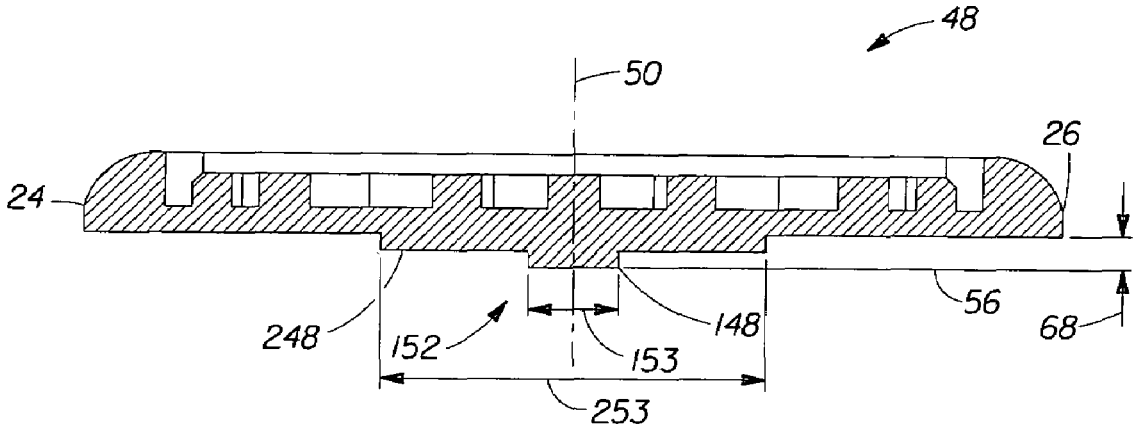
FIG. 4 is a cross sectional side view of the stepped design pad of FIG. 1, taken along line 3—3 thereof.
Figure 5:
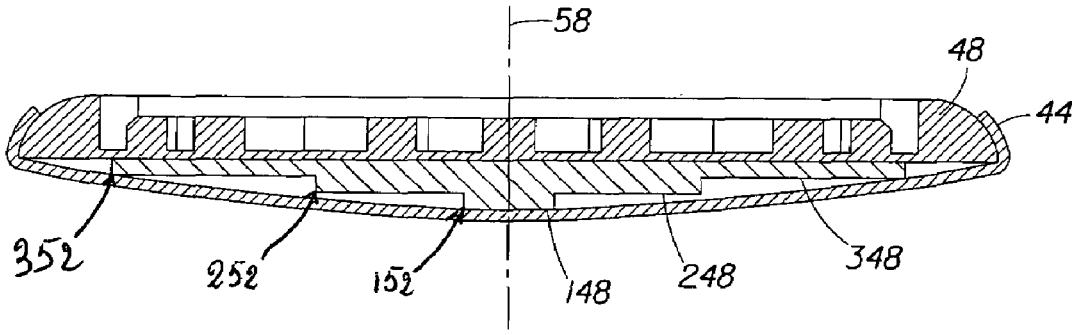
FIG. 5 is a cross-sectional side view of another stepped design pad of a floor mop further showing a cleaning sheet.

Referring to FIGS. 4 and 5 and in accordance with one aspect of the present invention, a pad 48 having a stepped design and which can be adhesively attached to the base of a mop head 22 is illustrated. In FIG. 4, a stepped design pad comprising two elevational elements 148 and 248 is illustrated. In FIG. 5, a stepped design pad comprising three elevational elements 148, 248 and 348 is illustrated. Of course, the present invention is not limited to stepped design pads comprising two or three elevational elements. One skill in the art will appreciate and understand that other stepped design pads may offer similar benefits such as for instance a stepped design comprising a single elevational element or a stepped design comprising more than three elevational elements. The bottom surface of the pad 48 engages at least a portion, and, more preferably, a substantial portion of the cleaning sheet 44 during use, as shown in FIG. 5. As illustrated in FIG. 4 and FIG. 5, the bottom surface of the pad 48 is provided with a profile shape, profile size, and gap which produces a repeated rocking motion of the mop head during use. Not intending to be bound by any theory, it is believed that the width 153 of the contact surface 152 provides a mop which can repeatedly "rock" or "pivot" or "rotate" about the contact surface 152 during any single continuous forward and/or backward sweeping motion of the mop 20, thereby increasing the surface of the cleaning sheet or pad 44 contacting with the dirt directly on the floor or in case of "wet cleaning" the liquid sprayed on the floor. Therefore, this rocking motion enables collection across a larger percentage of the surface area of the cleaning sheet 44 as the bottom surface of the sheet repeatedly engages and disengages the hard surface to be cleaned due to the rocking motion. As used herein, the phrase "contact surface" is intended to refer the portion of the cross-sectional profile of the bottom surface of either the mop head 22 or the cleaning sheet 44 contacted by a straight line 56 tangent to the apex of that bottom surface, wherein the straight line 56 is substantially perpendicular to the transverse axis 58 of the mop head 22.

In one embodiment, the stepped design pad is obtained by attaching at least one elevational element 148 to the pad 48 with fasteners such as adhesive, double faced adhesive tape, Velcro® or any other fasteners know in the art. The stepped design can also be obtained by molding the elevational element directly during the molding process of the pad 48 or the molding process of the mop head 22 such that it is permanently built in. Preferably, the width of the elevational element is smaller than the width of the mop head. In another embodiment, the elevational element is centered on the mop head such that the mop head is equally capable of pivoting forward and backward. In another embodiment of the invention, the stepped shape is obtained by attaching or molding a plurality of elevational element to the mop head. It will be appreciated that the edges of those elevational elements can be squared, rounded, angled, textured or any combination thereof. The surface 152, 252, and 352 etc. . . . of those elevational elements, which is facing the floor to be cleaned, is generally flat but a surface having discontinuities may be used with the same benefits. For instance, such discontinuities could be in the form of a grid, bumps or holes but other sorts of discontinuities might be used with the same benefits. The elevational elements can be made of a variety of material having different properties. For instance, those elevational elements can all be made of a material which is generally non-deformable. In another embodiment all the elevational elements can be made of a material which is generally deformable, such as foams, sponges, polyester wadding, encased gels or liquids and the like. Deformable materials would be defined as any materials that temporarily lose their shape under normal mopping pressures (about 0.1 to 0.2 psi), but which retrieve their original shape when pressure is relieved. The use of more deformable materials used to form the elevational element can also be beneficial by creating a pumping action improving liquid uptake as the absorbent pad is wiped across the surface, by improving rocking action, since such materials are more easily deformable as the implement is wiped in an back and forth motion and by providing cushioning which can protect the floor surface from possible damage and make wiping easier especially when thinner pads are used or cleaning pads which have an absorbent core narrower than the width of the mop head or dusting sheets. In yet another embodiment, a combination of generally non-deformable and deformable material can be used for different elevational elements. This combination of elevational elements made of material having different properties may increase or improve the ability of the mop head to pivot relative the surface to be cleaned. The mop head 22 and universal joint 30 are preferably formed from ABS type-polymers (e.g., terpolymer from acrylonitrile), polypropylene or other plastic material by injection molding. The stepped design pad 48 and each individual elevational element can be formed from polyurethane by molding or from ABS type-polymers (e.g., terpolymer from acrylonitrile), polypropylene or other plastic material by injection molding. The mop handle 32 can be formed from aluminum, plastic, or other structural materials.

U.S. Pat. No. 6,101,661 to Policicchio et al., the substance of which is hereby fully incorporated herein by reference, disclosed a cleaning pad comprising multiple planar surfaces contacting the surface to be cleaned. In such a cleaning pad, the thickness of all the layers forming the absorption substrate is sufficient to generate the desired rocking motion. However, it is believed that the combination of this cleaning pad with the improved cleaning implement will provide further improvement and/or allow optimization of the pad where the pad could be made thinner and/or less absorbent. Making the cleaning pad thinner and less absorbent is particularly useful in creating what would be referred to as a "light duty" pad. A light duty pad is beneficial for consumers with smaller homes who have less area to clean. For these consumers a standard pad having several layer of absorbent material may have too much "absorptive capacity"—which is defined as the maximum amount of solution a pad can uptake before it is exhausted. While there are benefits to creating a "light duty" pad, reducing the absorbent capacity and making the pad thinner can substantially affect the way this cleaning pad functions and performs. For example reducing the absorptive capacity results in lower "absorptive efficiency"—which is defined as the amount of solution a pad can uptake at a given amount of solution dosing and a given amount of contact time with the solution. In addition, as the pad is made thinner the "rocking action" during mopping is reduced. This results from a reduction in the height of the "pivot point" which is defined as the distance of the gap between the center part of the pad contacting the floor and the edge of the pad away from the floor. By building in a step design onto the bottom of the mop head, it is believed that the height of the pivot point created in the mop head rather than the pad or the height of the pivot point created by a combination of a step design in the mop head and a step design in the pad provides the same advantages than the cleaning pad disclosed in U.S. Pat. No. 6,101,661.

The improved cleaning implement having a mop head with a stepped design pad can also advantageously be used in combination with a cleaning pad comprising functional cuffs. It is believed that a more effective "rocking action" also makes it easier for the functional cuffs to more freely roll or shift back and forth during mopping. This results from more space being available for the cuff to roll over on itself.

As mentioned above, it is one object of this invention to improve the cleaning efficiency of the cleaning pad which can be linked to the absorptive efficiency of the cleaning pad. In order to measure the improved absorptive efficiency the following test was conducted.

Test Method To Measure the Absorptive Efficiency of a cleaning pad used with an improved cleaning implement:

Test Surfaces

Testing is done on both ceramic and pre-finished wood floors to measure under different floor quality conditions. The different results obtained can be explained in part by different "wetability" of the surfaces and by the fact that the ceramic tiles used in this test have grout lines (6 mm wide×3 mm deep) where solution can settle and make it more difficult for a cleaning pad to absorb since the contact between the cleaning pad and the surface is reduced. The test area is composed of 5×1 sqm test surfaces of tile and 5×1 sqm area of finished wood.

Test Protocol

In this test, a mop head with a flat pad and a mop head with a stepped design pad are each tested in combination with a two different "Standard Cleaning Pad" having different characteristics and one "Light Duty cleaning Pad". The stepped design pad comprises one elevational element which is attached with adhesive substantially in the center of the bottom of the mop head. The actual dimensions of the elevational element are 25 mm wide by 265 mm long by 1 mm high. This elevational element is attached to the bottom of a mop head which is 114 mm wide by 265 mm long. The flat mop head has the same dimension than the stepped design mop head to the extent it does not include an elevational element.

This test was performed with standard cleaning pads comprising 3 absorbent layers having different width, length and thickness. The first and second standard pad also comprise different pairs of "looped" functional cuffs. The "light duty" cleaning pad comprises two absorbent layers and a pair of "looped" functional cuffs similar to those used with the second "standard cleaning pad". The pair of functional cuffs used with the second standard pad and the light duty pad will be described in greater details hereinafter.

The following chart gives the characteristics of the two "standard" cleaning pads and the "light duty" pad used for this test:

| | First "Standard" Pad | Second "Standard" Pad | Light Duty Pad |
|---|---|---|---|
| Primary Absorbent Layer (Layer forming closest to the floor) | | | |
| Width - mm | 64 | 64 | 64 |
| Length - mm | 300 | 300 | 300 |
| Thickness - mm | 5 | 3 | 3 |
| Secondary Absorbent Layer | | | |
| Width - mm | 88 | 88 | |
| Length - mm | 300 | 300 | None |
| Thickness - mm | 3.5 | 3.5 | |
| Storage Absorbent Layer (Layer forming closest to mop head) | | | |
| Width - mm | 120 | 120 | 120 |
| Length - mm | 300 | 300 | 300 |
| Thickness - mm | 1.5 | 1.5 | 1.5 |
| Total Pad Thickness - mm | 10.0 | 8 | 4.5 |

-continued

| | First "Standard" Pad | Second "Standard" Pad | Light Duty Pad |
|---|---|---|---|
| Total Pivot Height - mm | 8.5 | 6.5 | 3.0 |
| Floor Sheet Design covering the absorbent layer | Apertured Formed Film | Apertured Formed Film | Apertured Formed Film |
| Functional Cuff Design | 60 gsqm hydra-entangled polyester with scrim | Dual layer-Apertured film inner cuff with 30 gsqm thru-air polyethelene: polyester bicomponent outer cuff | Dual layer-Apertured film inner cuff with 30 gsqm thru-air polyethelene: polyester bicomponent outer cuff |
| Total Absorptive Capacity - mils | 250 | 250 | 125 |

Over the first 1 sqm of test area apply 10 mils of cleaning solution (composed of 2% Propoxy Propanol solvent, 0.01% non-ionic surfactant and 0.005 of sodium hydroxide to pH 10.5) is spread evenly over the entire 1 sqm area. A pre-weighed dry pad is attached using Velcro® at the bottom of the mop head implement. Starting from the left side of the test area, the cleaning implement is wiped back and forth for 14 strokes until the end on the right side is reached. Going then from the right side to the left side of the test area, the cleaning implement is wiped back and forth for an additional 14 strokes. The person performing the test then moves to the next 1 sqm area and repeats the same procedure. When a total of 50 mils of liquid are applied to a total 5 sqm of floor area and wiped up with the cleaning pad the test is completed and the pad is re-weighed. The absorptive efficiency is calculated by determining the ratio of the amount of the solution absorbed by the cleaning pad relative to the 50 nails applied to floor and then multiplied by 100 to convert it into a percentage.

Results

Figure 6:
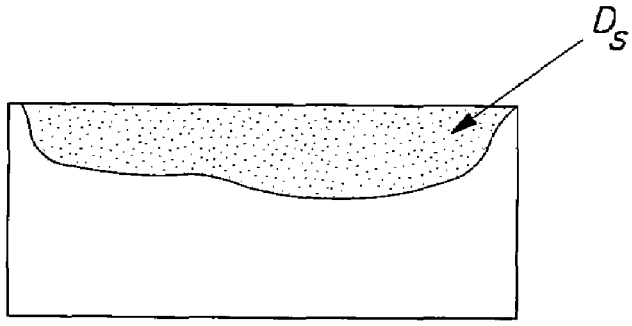
FIG. 6 is a schematic representation of the bottom surface of a cleaning pad used with a flat mop head.
Figure 7:
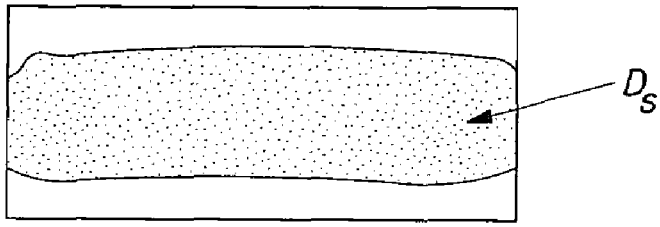
FIG. 7 is a schematic representation of the bottom surface of a cleaning pad used with a stepped design mop head.
Figure 8:
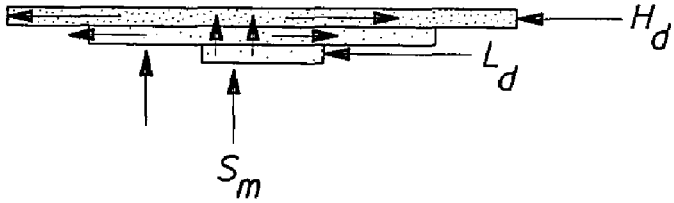
FIG. 8 is a schematic representation of a cross sectional side view of a cleaning pad used with a flat mop head.
Figure 9:
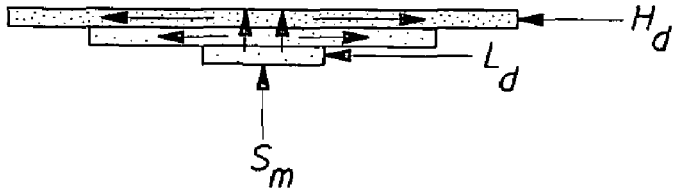
FIG. 9 is a schematic representation of a cross sectional side view of a cleaning pad used with a stepped design mop head.

It has been found that the absorptive efficiency for both "standard" cleaning pads and the "Light duty" cleaning pad is improved when wiping is done with a stepped mop head design as opposed to a standard mop head with a flat bottom. By observing the used pads which were tested with each mop head, it is apparent that having a stepped design not only generates a more pronounced pivot height and better cuff movement as described above, but the stepped design also creates an area of pressure in the center part of the cleaning pad which causes the cleaning solution to be absorbed through the center of the pad rather than at the leading edge. As a result, each cleaning pad tested is capable of absorbing a greater quantity of liquid and thus the cleaning efficiency of the cleaning pad is improved. This observation is schematically illustrated by FIG. 6 which shows where the dirty solution Ds is absorbed on a cleaning pad tested with a flat mop head and FIG. 7 which shows where the dirty solution Ds is absorbed on a cleaning pad tested with a stepped design mop head. The different layers of absorbent material forming the cleaning pads create a density gradient in the center area of the pads. As a result, those cleaning pads absorb more towards the center area. The stepped design mop head optimizes liquid uptake through the center area of the pad since the solution sprayed on the floor is forceably absorbed through the center portion of the cleaning pad and move in the z direction and the x y direction to make optimum use of the density gradient as illustrated in FIG. 8 and FIG. 9. FIG. 8 shows the solution movement Sm into a cleaning pad comprising three absorbent layers (the upper one having a high density Hd and the lower one having a low density Ld) used with a flat mop head. FIG. 9 shows the solution movement Sm into a cleaning pad also comprising three absorbent layers (the upper one having a high density Hd and the lower one having a low density Ld) used with a stepped design mop head. With a flat mop head design, the point of absorbency is shifted towards the leading edge of the cleaning pad and the benefit of having a density gradient in the pad is significantly reduced.

An important feature of the preferred cleaning pads and/or sheets of the present invention is the inclusion of one or more improved functional cuffs. Applicants have discovered that functional cuff(s) improve the cleaning performance of traditional cleaning pads and sheets, as well as the cleaning pads and sheets of the present invention. Functional cuffs provide improved particulate pick-up for traditional cleaning pads and sheets, as well as the cleaning pads and sheets of the present invention.

Figure 10:
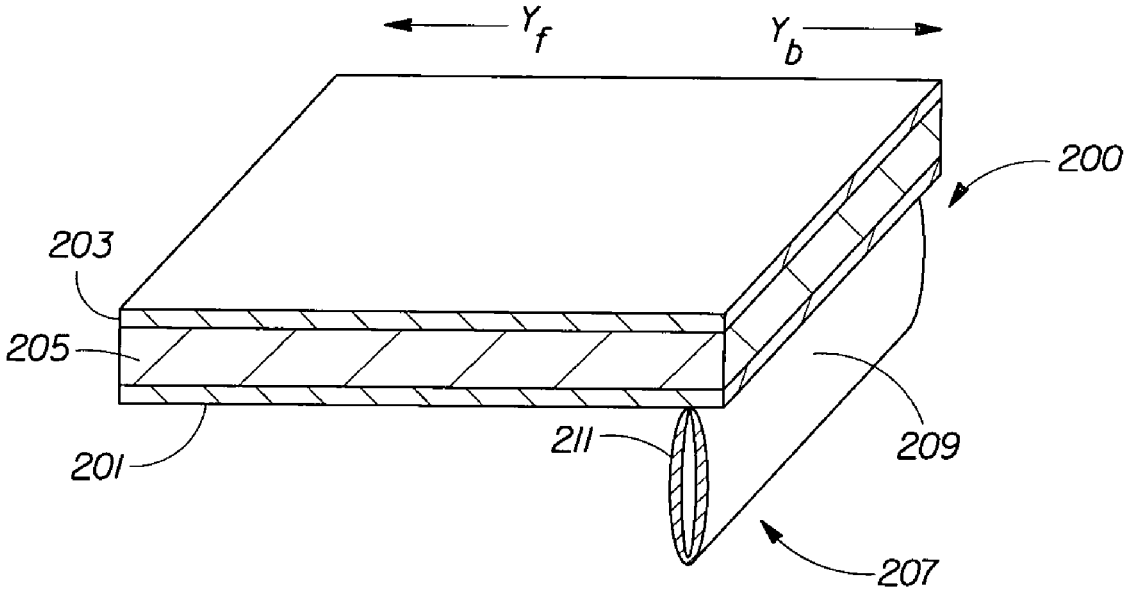
FIG. 10 is a perspective view of a cleaning pad comprising a functional cuff.
Figure 11:
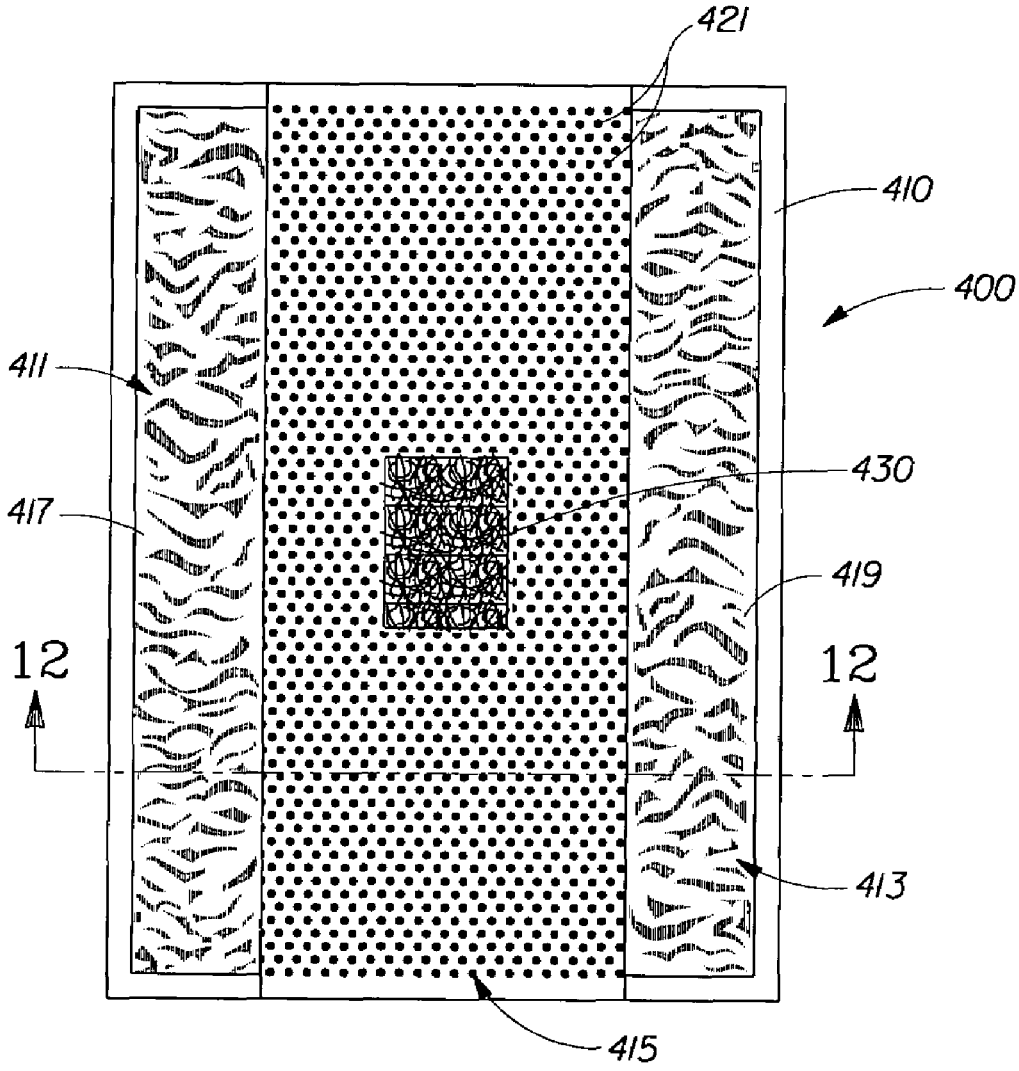
FIG. 11 is a plan view of a cleaning pad of the present invention.
Figure 12:
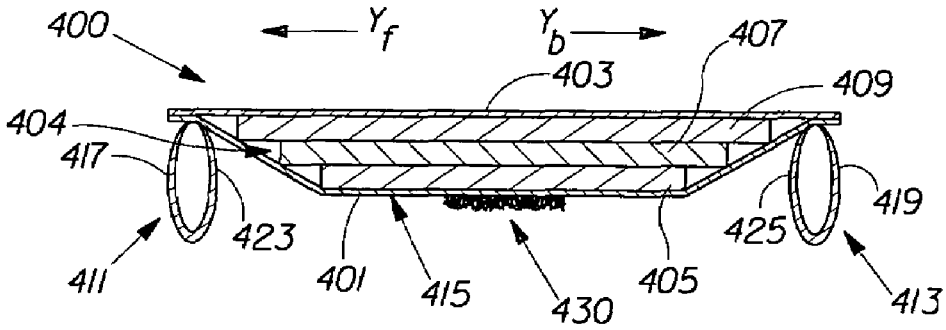
FIG. 12 is a cross sectional view of the cleaning pad shown in FIG. 11.

Cleaning pads comprising functional cuff(s) are exemplified in FIGS. 10, 11 and 12 of the drawings. FIG. 10 is a perspective view of a cleaning pad 200 comprising a free-floating, looped functional cuff 207. The looped functional cuff 207 has two surfaces 209 and 211. During a typical cleaning method, such as mopping or wiping, the cleaning pad 200 is moved forward in the $Y_f$ direction, then backward in the $Y_b$ direction across the surface being cleaned. As the cleaning pad 200 is moved in the $Y_f$ direction, the functional cuff 207 will flip such that its surface 211 is in contact with the surface being cleaned. Particulate matter on the surface being cleaned is picked-up by the surface 211 of the functional cuff 207. When the cleaning pad 200 is then moved in the $Y_b$ direction, the functional cuff 207 will then flip over such that its other surface 209 is in contact with the surface being cleaned. The particulate matter initially picked-up by surface 211 will be trapped between surface 211 of the functional cuff 207 and layer 201 of the cleaning pad 200. Surface 209 of the functional cuff 207 is then capable of picking-up additional particulate matter.

Figure 13:
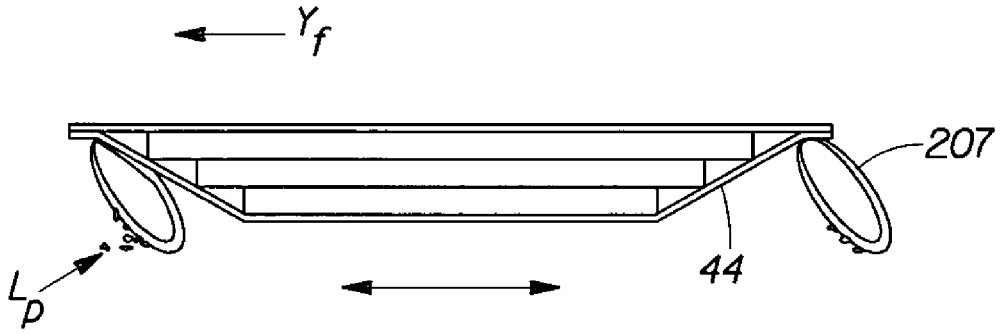
FIG. 13 is a schematic representation of a cross sectional side view of a cleaning pad comprising a pair of functional cuffs when mopping is done in a forward motion.
Figure 14:
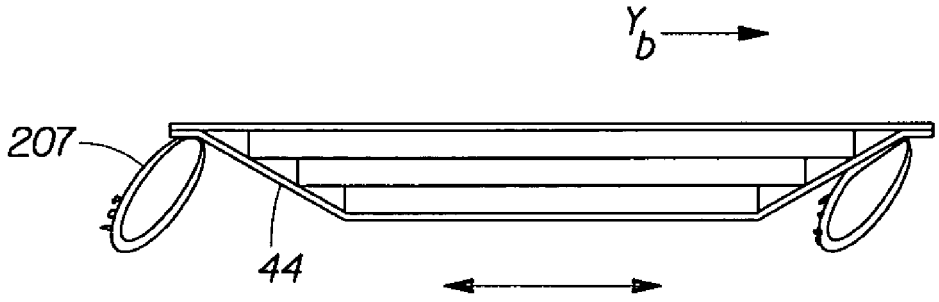
FIG. 14 is a schematic representation of a cross sectional side view of a cleaning pad comprising a pair of functional cuffs when mopping is done in a backward motion.

FIGS. 11 and 12 illustrate a cleaning pad 400 comprising two free-floating, looped functional cuffs 411 and 413, similar to the functional cuff 207 in FIG. 10. Referring to FIG. 12, during a typical cleaning method, the cleaning pad 400 is moved in the $Y_f$ direction across a hard surface and functional cuffs 411 and 413 are flipped such that surfaces 417 and 425 are in contact with the surface being cleaned and are capable of picking-up particulate matter. The cleaning pad 100 is then moved across the hard surface in the $Y_b$ direction, causing the functional cuffs 411 and 413 to flip over such that surfaces 419 and 423 are in contact with the surface being cleaned. The particulate matter picked-up by surface 425 is trapped between surface 425 and scrubbing layer 401. Surfaces 419 and 423 are then able to pick-up additional particulate matter from the surface being cleaned. When the cleaning pad 400 is moved back across the hard surface in the $Y_f$ direction, the additional particulate matter picked-up is trapped between surface 423 and scrubbing layer 401. Where functional cuff(s) are incorporated in cleaning pads having layers with multiple widths in the z-dimension, as in FIG. 12, the height (meaning the z-dimension of a fully-extended functional cuff) of the functional cuff is large enough so that when the functional cuff flips toward the mid-line of the cleaning pad, it overlaps the layer having the narrowest width. FIG. 11 shows a cleaning pad 400 comprising two functional cuffs 411 and 413, wherein the functional cuffs 411 and 413 are both flipped toward the mid-line of the cleaning pad, which is preferable for packaging the cleaning pad 400 for resale. The action of the cuffs is schematically illustrated FIGS. 13 and 14 showing how large particles Lp are trapped by the cuffs 207 attached to a cleaning pad or sheet 44 when the mop is moved in a forward Yf and backward Yb motion.

As a cleaning pad and/or sheet comprising functional cuff(s) is wiped back and forth across a hard surface, the functional cuff(s) "flip" or "roll" from side to side, thus picking-up and trapping particulate matter. Cleaning pads and sheets having functional cuff(s) exhibit improved pick-up and entrapment of larger particulate matter, which are typically found on a hard surfaces, and have a reduced tendency to redeposit such particulate matter on the surface being cleaned. In addition to collecting larger particulate, the cuffs play an important role in helping to spread solution and smooth out any lines created by the textures in the floor sheet in order to minimize the formation of streaks during drying. This attribute of helping to spread solution is particular important in the context of a "wet" cleaning implement where the solution is sprayed over a specific concentrated area, often at lower dosing or floor wetness levels compared to conventional systems and then wiped over with an absorbent pad. Since the dosing is low and concentrated to an area covered by the spray pattern width, the pad needs to loosen soil but absorb at a controlled rate. If the pad absorbs too quickly, dry spots will be created during mopping which will lead to streaks from a dry pad wiping across a soiled floor. When the outer part of the cuff is composed of a non-woven material, the cuff is typically able to absorb some liquid between the interstitial spaces between the fibers which make-up the non-woven material. The liquid absorbed by the cuffs is subsequently released during the mopping motion thus helping to spread the liquid more uniformly during mopping and minimizing creating streaks from mopping with a dry cleaning pad. As indicated earlier, streaks from mopping with a dry pad result from the pad absorbing too quickly particularly when solution dosing is very low or actual spraying of solution is done at a lower frequency intervals (for example, sprayed solution applied every 2 sqm as compared to every ½ sqm which is what would be recommended since this is the approximate width typically covered by the spray pattern). The solution spreading attribute provided by the cuff is also further enhanced when the cuff on the leading edge is facing towards the center during the forward mopping motion or the when a cuff on the trailing edge is facing the center during the back mopping motion.

When the cuff faces the center of the pad it breaks the contact between the floor sheet and the floor over the area covered by the cuff. The portion of the pad covered by the cuff has a reduced absorbing ability since the liquid needs to be absorbed through multiple layers before being able to enter into the core absorbent layer(s)(liquid needs to penetrate through the layers forming the cuff and through potentially the apertured formed film of the cleaning pad).

As described earlier, the cuffs play an important role in providing large particulate, hair and lint "trapping" benefits as well as solution spreading. Those characteristics are critical to the overall performance of the cleaning pad. Also as described above, the cuffs optimally function by moving back and forth during the up and down mopping motion. To optimize this ability for the functional cuffs to move back and forth it has been found that the outer cuff characteristics (outer referring to part of cuff that actually contacts floor during mopping) should be different from the inner cuff characteristics (inner referring to part of cuff that rubs against itself during mopping). It has been found that for an optimized cuff design, the inner part of the cuff has a lower friction or "glide" when it rubs against itself as compared to the outer part of the cuff which has a higher friction or "glide" when it rubs against the floor. This differential in friction leads to a different level of force being required to cause the materials to slide or move. The cuffs are better able to freely move back and forth because the force required to break the temporary bond formed between the outer cuff and the floor is easily greater than the force required to break the temporary bond between the inner cuff on itself.

Functional cuffs can comprise a variety of materials, including, but not limited to, appertured formed film, carded polypropylene, rayon or polyester, hydroentangled polyester, spun-bonded polypropylene, polyester, polyethlene, or cotton, polypropylene, or blends thereof. Where free-floating functional cuffs are utilized, the material used for the functional cuffs should be sufficiently rigid to allow the cuffs to "flip" from side to side, without collapsing or rolling-over on itself. Rigidity of the functional cuffs can be improved by using high basis weight materials (e.g., materials having a basis weight of greater than about 30 $g/m^2$) or by adding other materials to enhance rigidity such as scrim, adhesives, elastomers, elastics, foams, sponges, scrubbing layers, and the like, or by laminating materials together. Preferably, the functional cuffs comprise a hydroentangled substrate including, but not limited to, polyester, cotton, polypropylene, and mixtures thereof, having a basis weight of at least about 20 $g/m^2$ and a scrim material for stiffening.

In order to determine what material would be the most suitable to obtain a cuff having the desired characteristics described earlier, the following test was conducted.

Determination of Material for Inner Cuff:

The following testing is conducted to determine which materials exhibit characteristics where the least amount of resistance results when the material is rubbed against itself in both a dry and wet state.

Test Method:

Equipment: Force gauge (MF Shimpo Force gauge 0–2 lb.), 500 g weight (6 cm round by 2 cm thick), Substrates, Solution (0.04% Surfactant, 2% solvent in water), Tape.

Procedure:

1. A sample of substrate to be tested of 20 cm wide by 30 cm long is prepared. It is then stretched and taped down onto a test surface with the part of the material which would represent the inside part of the cuff facing up.
2. Another sample of the same material is cut into 12×12 sqcm. This sample is wrapped and taped around the 6 cm round weight with the pant representing the inside of a cuff facing down.
3. With a pen, a mark is made at 2.5 cm in front of back edge of taped down substrate (this represents starting point) and another mark is made at 20 cm forward from the first mark (this represents ending point).
4. The round weight with the wrapped substrate is positioned in front of starting line. The force gauge is attached to the round weight and reads zero. Then, the weight is pushed forward at a slow but constant speed until it passes the 20 cm mark. The force read on the force gauge is then recorded. The same procedure is repeated 3 times with same material. This is test is referred as the glide on the dry substrate.

5. To measure the wet glide, 10 full sprays of a cleaning solution contained in a bottle is applied on the substrate taped down onto the test surface (about 10 mils) and one full spray of the same solution is applied on the test side of substrate wrapped around the weight.
6. Again, the weight with substrate is placed in front of the starting line and pressed firmly. The force gauge is attached to the round weight and reads zero. Then, the weight is pushed forward at a slow but constant speed until it passes the 20 cm mark. The force read on the force gauge is then recorded. The same procedure is repeated 3 times with same material. This is test is referred as the glide on the wet substrate.

The results of this test are reported in table 1 hereinafter:

TABLE 1

| Example | Material tested on Same Material | Dry Glide - lb. of force (average 3 reps) | Wet Glide - lb. of force (average 3 reps) |
|---|---|---|---|
| 1 | 20 gsqm apertured formed film (DRI WEAVE film with wide funnel - female side representing the test contact surface) - | 0.7 standard deviation 0.05 | 0.25 standard deviation 0 |
| 2 | 20 gsqm apertured formed film (DRI WEAVE film with narrow funnel - male side representing test contact surface) | 2.4 standard deviation 0.05 | 2.0 standard deviation 0.04 |
| 3 | 20 gsqm apertured formed film with dual hole size (DRI WEAVE film with wide funnel - female side representing test contact surface) | 1.0 standard deviation 0.05 | 0.5 standard deviation 0 |
| 4 | 20 gsqm apertured formed film with dual hole size (DRI WEAVE FILM with narrow funnel - male side representing test contact surface)- | 1.5 standard deviation 0.05 | 2.2 standard deviation 0.04 |
| 5 | 20 gsqm spun-bond polyester (with binder) | 0.38 standard deviation 0.03 | 0.35 standard deviation 0.03 |
| 6 | 20 gsqm apertured film code PF/12 (female side representing test contact surface) | 0.7 standard deviation 0.05 | 0.35 standard deviation 0.01 |
| 7 | 20 gsqm apertured film code PF/12 (male side representing test contact surface) | 1.8 standard deviation 0.05 | 1.2 standard deviation 0.03 |
| 8 | 20 gsqm polyethylene film | 1.0 standard deviation 0.05 | 0.3 standard deviation 0.01 |
| 9 | 20 gsqm polypropylene carded process | 0.65 standard deviation 0.01 | 0.67 0.03 |
| 10 | 40 gsqm polyester needle punched - Flow Clean | 0.68 standard deviation 0.04 | 0.78 standard deviation 0.03 |
| 11 | 40 gsqm hydra-entangled polyester- | 0.88 standard deviation 0.03 | 0.85 standard deviation 0.05 |
| 12 | 50 gsqm hydra-entangled polyester one side laminated with 10 gsqm polypropylene scrim facing test surface- | 0.67 standard deviation 0.03 | 0.55 standard deviation 0.01 |
| 13 | 30 gsqm thru-air bond polyester + polyethylene:polyester bicomponent | 0.85 standard deviation 0.03 | 0.85 standard deviation 0.02 |

Determination of Material for Outer Cuff:

The following testing is conducted to determine which materials exhibit characteristics where the greatest amount of resistance results when the material is rubbed against a surface (simulating a hard surface to be cleaned) in both a dry and wet state. A smooth, very shiny, glazed ceramic tile is chosen as the test surface since it very slippery.

Test Method:

Equipment: Force gauge (MF Shimpo Force gauge 0–2 lb.), 500 g weight (6 cm round by 2 cm thick), Substrates, Solution (0.04% Surfactant, 2% solvent in water), Tape, Ceramic Floor tile 13"×13" Italian glazed tile manufactured by Valentino Kerastone-Ceramiche Piemme-41053 Maranello Italy.

Procedure:

1. The ceramic tile is positioned on the test surface and taped down with a 2 sided tape to prevent it from moving.
2. A sample of the material to be tested is cut into a 12×12 sqcm sample. It is then wrapped and taped around the 6 cm round weight with the part representing the outside cuff material facing down against floor surface.
3. With a pen, a mark is made at 2.5 cm in front of back edge of taped down substrate (this represents starting point) and another mark is made at 20 cm forward from the first mark (this represents ending point).
4. The round weight with the wrapped substrate is positioned in front of starting line. The force gauge is attached to the round weight and reads zero. Then, the weight is pushed forward at a slow but constant speed until it passes the 20 cm mark. The force read on the force gauge is then recorded. The same procedure is repeated 3 times with same material. This is test is referred as the glide on the dry substrate.
5. To measure the wet glide, 10 full sprays of a cleaning solution contained in a bottle is applied on ceramic tile spread out uniformly (about 10 mils) and one full spray of the same solution is applied on the test side of substrate wrapped around the weight.
6. Again, the weight with substrate is placed in front of the starting line and pressed firmly. The force gauge is attached to the round weight and reads zero. Then, the weight is pushed forward at a slow but constant speed until it passes the 20 cm mark. The force read on the force gauge is then recorded. The same procedure is repeated 3 times with same material. This is test is referred as the glide on the wet substrate.

The results of this test are reported in table 1 hereinafter:

TABLE 2

| Example | Material Side Tested on Surface | Dry Glide - lb. of force (average 3 reps) | Wet Glide - lb. of force (Average 3 reps) |
|---|---|---|---|
| 1 | 20 gsqm apertured formed film (DRI WEAVE film with wide funnel - female side representing test contact surface) - | 1.2 standard deviation 0.05 | 0.3 standard deviation 0 |
| 2 | 20 gsqm apertured formed film (DRI WEAVE film with narrow funnel - male side representing test contact surface) | 2.2 standard deviation 0.05 | 0.8 standard deviation 0.01 |
| 3 | 20 gsqm apertured formed film with dual hole size (DRI WEAVE film with | 1.2 standard | 0.5 standard |

TABLE 2-continued

| Example | Material Side Tested on Surface | Dry Glide - lb. of force (average 3 reps) | Wet Glide - lb. of force (Average 3 reps) |
|---|---|---|---|
| | wide funnel - female side representing test contact surface) | deviation 0.05 | deviation 0 |
| 4 | 20 gsqm apertured formed film with dual hole size (DRI WEAVE FILM with narrow funnel - male side representing test contact surface) | 2.4 standard deviation 0.05 | 1.8 standard deviation 0.04 |
| 5 | 20 gsqm spun-bond polyester Remay (with binder) | 0.9 standard deviation 0.03 | 0.3 standard deviation 0.03 |
| 6 | 20 gsqm apertured film code PF/12 (female side representing test contact surface) | 1.3 standard deviation 0.05 | 0.4 standard deviation 0.01 |
| 7 | 20 gsqm apertured film code PF/12 (male side representing test contact surface) | 1.7 standard deviation 0.05 | 0.7 standard deviation 0.01 |
| 8 | 20 gsqm polyethylene film | 2.0 standard deviation 0.05 | 0.35 standard deviation 0.01 |
| 9 | 20 gsqm polypropylene carded process | 1.5 standard deviation 0.01 | 0.3 standard deviation 0.03 |
| 10 | 40 gsqm polyester needle punched - Flow Clean | 1.5 | 0.6 |

It is found that materials such as those shown in Examples 1, 3, 5, 6 and 8 provide good characteristics for an inner cuff material because of the low friction as indicated by the low glide values on material to material when tested as inner cuffs shown in Table 1. Preferred materials are typically apertured film with the female side in to form inner cuff in the case of examples 1, 3 and 6 or unapertured film in the case of Examples 8. Alternative materials can be non-woven materials where fibers that have been coated with a high degree of chemical or adhesive coating or binder making the structure smooth such as in Example 5.

In a dual layer cuff design, materials such as those shown in Examples 10, 11, 12 and 13 provide good characteristics for an outer cuff material because of the high friction as indicated by the high glide values when tested as outer cuffs shown in Table 2. These materials are typically non-wovens where the formation process leaves many free fibers. Additionally, the fiber matrix has certain degree of integrity and capillary spaces created by thermal bonding (spun-bond, meltblown or carding), differential melt-point fiber bonding (bicomponent fibers put in through air dryer) or entangling (hydro-spun-lacing). The free fibers and capillary spaces allow structure to absorb some liquid which is part of what results in the high friction when contacting a wet floor. Example 9 while being a thermally bonded non-woven has too much of its fibers tacked down from a tight embossed pattern. These leaves very few free-fibers and capillary spaces therefore resulting in a poor low glide when tested as an outer cuff. The free fibers characteristic in these materials are also beneficial in providing attachment hooks for larger soils such as lint, hair and dust (capturing these soils is key function for cuffs).

While the cuff can be formed by layering two different materials, it is also possible to form an effective cuff by choosing a material which has good characteristics as an outer cuff and on the inner side applying a scrim. Such a material is shown by Example 12 where the scrim side was tested as an inner cuff and gave in a material to material wet glide of 0.55 lb. of force while the opposite side was tested as an outer cuff and gave a material to surface wet glide of 065 lb. of force. It is also possible to form a unitary cuff structure by applying a chemical treatments, adhesives, and other polymers or any combination thereof to one side in order to coat the fibers on that side such that the resulting surface has a material to material wet glide lowered after the treatment. In addition, it has been found that specific apertured films like those described in Example 1–2; Examples 3–4; and Example 6–7 in Tables 1 and 2, could also be used to form a single layer cuff. In a dual layer cuff design, typically the smoother side of the apertured film (often referred to as female side) is placed inward since it has the lowest material to material friction (wet glide). The opposite side (referred to as male side) typically has protrusions created during the forming or puncturing process and which makes it more textured and therefore result in a higher material to material friction (wet glide). In fact the material to surface glide for the textured part of the described apertured films is higher than the material to material friction (wet glide) for the female part of the film. This is shown when comparing Example 1 to Example 2, Example 3 to Example 4 and Example 6 to Example 7 in Tables 1 and 2 where in each comparison the female side consistently gave lower friction wet (glide) relative to the male side. This allows this material to be suitable as a unitary cuff design. In particular, it has been found that this type of material is beneficial for applications requiring scrubbing of the surface to be cleaned. While the texture of the male side also contributes to the trapping of lint, hair and dirt, it has been found that spraying, coating, screen printing etc. a layer of adhesive, chemical treatment, and the like, to some or all of its outer surface enhances these properties and/or increase the material to surface friction (wet glide) if needed. Alternatively, other good materials used as outer cuffs because of their fibrous characteristics such as those described in Table 1 and 2 above (examples 10, 11, 12 and 13), could be adhesively bonded, thermally bonded, mechanically bonded, ultrasonically welded as strips, squares, circles, diamonds and the like such that the outer cuff composed of an apertured film has some areas where the male protrusions are exposed to provide scrubbing. Optionally rather than complete non-wovens, the actual fibers making up non-wovens such polypropylene, polyester, polyethylene, nylon, rayon etc. and/or natural fibers such as cellulose, hemp etc. could be applied as a complete coverage or partial coverage as zones to the outer part of the apertured film to form the cuff as a unitary layer.

Most of the discussion above has focused on cuffs designed to function optimally in wet environment such as wet mopping. However, having functional cuffs can be beneficial to improving the performance of dry dusting sheets. However, the inner cuff characteristics and outer cuff characteristics need to be based on friction without presence of liquid (dry glide).

Similar to wet mopping applications, for dry dusting the preferred characteristics are for the inner cuff side to have a material to material friction dry (dry glide) that is lower than the material to surface friction dry (dry glide) for the outer cuff side.

When considering characteristics for inner cuff, the material to material friction or glide values should be less than about 0.6 lb. force, preferably less than about 0.5 lb. of force, and more preferably less than about 0.4 lb. of force. For the outer cuff the material to surface friction or glide should be greater than about 0.4 lb. force, preferably more than about 0.5 lb. of force, and more preferably more than about 0.6 lb. of force. Additionally, the ratio between inner cuff material to material friction or wet glide and outer cuff material to surface friction or glide should be less than about 1, preferably less than about 0.9, and more preferably less than about 0.75.

In another embodiment of the invention, at least two layers of material are used to form the functional cuff. Those layers are partially attached to each other via selective attachment points between the inner cuff and outer cuff materials. Those selective attachment points allow for open spaces or channels between the layers. This not only provides spaces for soil which penetrates through the outer layer to get trapped, but provides the loop with more bulk which minimizes the cuffs propensity to flatten out and crease under the pressures the cuff goes through initially during manufacturing and then during mopping.

The functional cuffs can be in the form of a mono-layer or a multiple-layer laminate structure, and in the form of a loop or a non-loop structure. Preferably, the functional cuffs comprise a loop, as shown in FIGS. 10 through 14 of the drawings. A looped functional cuff can be constructed by folding a strip of cuff material in half to form a loop and attaching it to the substrate. Non-loop functional cuffs can also be used, particularly if the material used has sufficient rigidity. The cleaning pads and sheets of the present invention can also comprise a combination of loop and/or non-loop, mono-layer and/or multiple-layer functional cuffs. In addition, the functional cuffs can comprise an absorbent layer, as described below.

Functional cuffs can be formed as an integral part of the lower layer of a cleaning pad or the substrate of a cleaning sheet, or separately adhered to a cleaning pad and/or sheet. If the functional cuffs are an integral part of the lower layer of the cleaning pad and/or sheet, the functional cuffs are preferably a looped functional cuff formed by crimping the cleaning pad lower layer or cleaning sheet substrate, for example, in a Z-fold and/or C-fold. Alternatively, the functional cuffs can be separately adhered to the lower layer of a cleaning pad and/or cleaning sheet via a variety of methods known in the art including, but not limited to, double-sided adhesive tape, heat bonding, gluing, ultrasonic welding, stitching, high-pressure mechanical welding, and the like.

Functional cuff(s) can be incorporated in traditional cleaning pads and sheets that are well-known in the art which comprise a variety of cellulosic and nonwoven material, such as sponges, foam, paper towels, polishing cloths, dusting cloths, cotton towels, and the like, both in a dry and pre-moistened form. In a preferred embodiment, functional cuffs are particularly effective when incorporated in the cleaning pads of the present invention, as well as those described in co-pending U.S. patent application Ser. No. 08/756,507 (Holt et al), U.S. Pat. No. 5,960,508, copending U.S. Patent application Ser. No. 08/756,507,864 (Sherry et al.), U.S. Pat. No. 6,003,191, copending U.S. patent application Ser. No. 08/756,999 (Holt et al.), U.S. Pat. No. 6,048,123, all filed Nov. 26, 1996; and copending U.S. patent application Ser. No. 09/037,379 (Policicchio et al.), U.S. Pat. No. 6,101,661, filed Mar. 10, 1998; all of which are hereby incorporated by reference.

In another embodiment, a cleaning sheet comprises one or more functional cuffs and a substrate, preferably a nonwoven substrate comprising a hydroentangled material, including, but not limited to, the substrates described in copending applications by Fereshtehkhou et al., U.S. Ser. No. 09/082,349, abandoned, filed May 20, 1998; Fereshtehkhou et al., U.S. Ser. No. 09/082,396, U.S. Pat. No. 6,561,354 filed May 20, 1998; the disclosure of which is hereby incorporated by reference; and U.S. Pat. No. 5,525,397, issued Jun. 11, 1996 to Shizuno et al. In this preferred embodiment, the substrate of the cleaning sheet has at least two regions, where the regions are distinguished by basis weight. The substrate can have one or more high basis weight regions having a basis weight of from about 30 to about 120 g/m$^2$, preferably from about 40 to about 100 g/m$^2$, more preferably from about 50 to about 90 g/m$^2$, and still more preferably from about 60 to about 80 g/m$^2$, and one or more low basis weight regions, wherein the low basis weight region(s) have a basis weight that is not more than about 80%, preferably not more than about 60%, more preferably not more than about 40%, and still more preferably not more than about 20%, of the basis weight of the high basis weight region(s). The substrate of the cleaning sheet will preferably have an aggregate basis weight of from about 20 to about 110 g/m$^2$, more preferably from about 40 to about 100 g/m$^2$, and still more preferably from about 60 to about 90 g/m$^2$.

One or more functional cuff(s) can be applied to, or formed as an integral part of, cleaning pads and sheets in a variety of locations on the pads and sheets. For example, the functional cuff(s) can be situated along the mid-line of the cleaning pad or sheet (in the x-y plane) along either the x-dimension or the y-dimension. Preferably, the cleaning pad or sheet comprises two functional cuffs situated at or near opposite edges (e.g., the leading and trailing edges of the pad and/or sheet, in terms of the y-dimension) of the cleaning pad or sheet. Preferably, the functional cuff(s) are placed in a location such that their length is perpendicular to the back and forth mopping or wiping direction used by the consumer.

The present invention further encompasses articles of manufacture comprising the above-described cleaning pad and/or sheet comprising improved functional cuffs in association with a set of instructions, which can be combined with a package, carton, or other container. The present invention also encompasses articles of manufacture comprising the above-described improved cleaning implement in association with a set of instructions, which can be combined with a package, carton, or other container. As used herein, the phrase "in association with" means the set of instructions are either directly printed on the cleaning sheet itself or presented in a separate manner including, but not limited to, a brochure, print advertisement, electronic advertisement, and/or verbal communication, so as to communicate the set of instructions to a consumer of the article of manufacture. The set of instructions preferably comprise the instruction to use the cleaning pad and/or sheet comprising improved functional cuffs for hard surface cleaning with a cleaning implement, such as a floor mop, having a handle and a mop head. The set of instructions can further comprise instructions to use the cleaning pad and/or sheet comprising improved functional cuffs or any other kind of cleaning pad with a floor mop having a stepped design mop head configured as previously described herein. For example, the instruction might instruct using the cleaning sheet with a floor mop having a stepped design mop head. Other instructions might instruct a user to attach the cleaning sheet or pad to the mop head, move the floor mop, and then remove the cleaning sheet from the mop head.

What is claimed is:

1. A cleaning implement for cleaning a floor surface comprising:

(a) a handle;

(b) a disposable cleaning pad comprising a cleaning layer having an upper surface adapted to be at least indirectly connected to the handle and a lower surface adapted to be moved along the surface of a floor, said cleaning layer further including leading and trailing edges; and (c) a free floating looped functional cuff connected to said cleaning layer adjacent one of the edges thereof, said cuff comprising a cuff material having an inner surface and an outer surface, said outer surface includes a textured material selected from one of an apertured film and a scrim, said functional cuff being movably secured to the cleaning layer such that the cuff is flipped as the cleaning layer is moved back and forth on the floor surface such that opposed outer surfaces of the looped cuff are alternately brought into engagement with the floor surface.

2. The cleaning implement of claim 1, wherein said cleaning pad further comprises a second free-floating functional cuff.

3. The cleaning implement of claim 1, wherein said apertured film has a male and a female side wherein said female side forms the inner surface of said cuff material.

4. The cleaning implement of claim 3, wherein said male side is at least partially covered with a non-woven material.

5. A cleaning pad for cleaning a floor surface comprising:

at least a cleaning layer; and at least a free floating looped functional cuff connected to said cleaning layer, said cuff comprising a cuff material having an inner surface and an outer surface, said outer surface being capable of contacting a surface to be cleaned wherein said cuff material includes a textured material comprising an apertured film, said apertured film having a male side and a female side wherein said female side forms the inner surface of said cuff material.

6. The cleaning pad of claim 5, wherein said cleaning pad further comprises a second free floating looped functional cuff.

7. The cleaning pad of claim 6, wherein said functional cuffs comprise a single layer of material.

8. The cleaning pad of claim 5, wherein said male side is at least partially covered with a non-woven material.

9. The cleaning pad of claim 5, wherein said functional cuff comprises a multi-layer material.

10. The cleaning pad of claim 9, wherein said multi-layer material comprises a first layer which forms the outer surface of said cuff, at least partially attached to a second layer which forms the inner surface of said cuff.

11. The cleaning pad of claim 10, wherein said first layer comprises a non-woven material.

12. The cleaning pad of claim 5, wherein said disposable cleaning pad further comprises a plurality of absorbent layers, wherein said absorbent layers have multiple widths in the z-dimension.

13. The cleaning pad of claim 5, wherein said cleaning pad further comprises a second free floating looped functional cuff comprising a scrim.

14. A cleaning pad for cleaning a floor surface and for use with a handle, the cleaning pad comprising:

a cleaning layer having an upper surface adapted to be at least indirectly connected to the handle and a lower surface adapted to be moved along the surface of a floor, said cleaning layer further including leading and trailing edges;

a free floating looped functional cuff connected to said cleaning layer adjacent one of the edges thereof, said cuff comprising a cuff material having an inner surface and an outer surface, said outer surface includes a textured material selected from one of an apertured film and a scrim, said functional cuff being movably secured to the cleaning layer such that the cuff is flipped as the cleaning layer is moved back and forth on the floor surface such that opposed outer surfaces of the looped cuff are alternately brought into engagement with the floor surface.

* * * * *